United States Patent [19]

Rollins

[11] 4,057,604

[45] Nov. 8, 1977

[54] EXHAUST POLLUTION REDUCTION APPARATUS FOR INTERNAL COMBUSTION ENGINE CARBURETOR

[76] Inventor: Eugene C. Rollins, 3515 Fowler Ave., Ogden, Utah 84403

[21] Appl. No.: 674,853

[22] Filed: Apr. 8, 1976

[51] Int. Cl.[2] ..... F02M 17/16

[52] U.S. Cl. ..... 261/88

[58] Field of Search ..... 261/88, 84, 83, 117, 261/89, 90; 55/230

[56] References Cited

U.S. PATENT DOCUMENTS

| | | | |
|---|---|---|---|
| 621,718 | 3/1899 | Seymour, Jr. | 261/89 |
| 1,098,389 | 6/1914 | Lister | 261/88 |
| 1,650,292 | 11/1927 | Miscampbell | 261/88 |
| 1,679,793 | 8/1928 | Smith et al. | 261/88 |
| 1,883,456 | 10/1932 | Ashley | 261/88 |
| 1,951,962 | 3/1934 | Baum | 261/90 |
| 2,313,976 | 3/1943 | Sullivan et al. | 261/89 |
| 2,315,052 | 3/1943 | Ericson | 261/83 |
| 3,991,144 | 11/1976 | Diener | 261/88 |

FOREIGN PATENT DOCUMENTS

| | | | |
|---|---|---|---|
| 538,043 | 5/1955 | Belgium | 261/89 |
| 145,927 | 7/1920 | United Kingdom | 261/88 |

*Primary Examiner*—Tim R. Miles

*Attorney, Agent, or Firm*—Schmidt, Johnson, Hovey & Williams

[57] ABSTRACT

An air rotor within the carburetor bore and rotated by air drawn into the bore during engine operation has extremely small diameter fuel jets associated therewith that inject fuel into the bore in counterflow relationship to the inrush of air, thereby markedly increasing atomization. In addition, the jets are directed to inject the fuel into the bore in a forward direction with respect to the direction of rotation of the rotor, hence propelling the fuel against the force of air in the bore to thereby further promote atomization. These features function independently and in cooperation with one another to increase engine operating efficiency and decrease the level of polluting emissions.

6 Claims, 15 Drawing Figures

EXHAUST POLLUTION REDUCTION APPARATUS FOR INTERNAL COMBUSTION ENGINE CARBURETOR

This invention relates to carburetion techniques for use with internal combustion engines and, more particularly, to apparatus which will markedly increase the operating efficiency of the engine and reduce its level of polluting emissions, particularly during initial start-up and run at low temperature conditions.

With the increasingly stringent demands being placed on vehicle manufacturers from various governmental authorities to increase the operating efficiency and reduce the pollutants produced by the internal combustion engines of such vehicles, the development of a truly effective and practical apparatus to achieve these goals is of utmost importance. Initial start-up and run at low temperature conditions poses a particularly severe problem because fuel vaporization is rendered increasingly difficult by the cold atmosphere to which the fuel is subjected.

Typical mechanisms currently available for initially enriching the air-fuel ratio to encourage start-up and smooth running at low temperatures employ a troublesome butterfly valve to restrict the air drawn into the carburetor during that phase of engine operation. Restricting the incoming air in this manner imposes a high vacuum internally in the carburetor to assist in drawing large quantities of fuel from the supply nozzle. When properly adjusted, such a butterfly valve actuated by a thermostatic coil sensitive to exhaust temperature can perform in an acceptable manner. However, in the hands of the ultimate user and his service personnel, a valve of this type is subject to malfunction and maladjustment. It is common practice among service personnel to adjust the carburetor settings such that the air-fuel ratio is overly rich for the purpose it must serve; consequently, large quantities of fuel may be wasted and the level of pollutants made needlessly high as a result of incomplete combustion.

Moreover, in order for a butterfly valve to perform properly, it must be free to rotate easily on its supporting shaft. In time, however, dust and gum accumulate on the shaft and inhibit the freedom of operation of the valve, thereby causing it to malfunction.

In addition to the problems with conventional automatic choke mechanisms which utilize air-restricting butterfly valves, problems have always been experienced by the industry in achieving the degree of atomization necessary for intimate mixture with the air and the complete combustion which should result. Such is particularly true under low operating temperatures at initial start-up when the fuel is inherently reluctant to vaporize and excessive amounts of condensation may exist on the cold manifold. Numerous efforts have heretofore been made, with varying degrees of success, to improve atomization and mixing. Two examples of devices which have exhibited high degrees of success are illustrated in my prior U.S. Pat. Nos. 2,668,698, entitled "Carburetor", and 3,654,909, entitled "Carburetor Having Auxiliary Turbine and Idle Fuel Shutoff Mechanism."

It is, therefore, one important object of the present invention to provide practical and reliable fuel enrichment apparatus usable during initial start-up and run at a low ambient temperature which obviates the need for the heretofore troublesome butterfly valve or other such mechanism that enriches the air-fuel mixture by restricting the flow of incoming air to the engine.

As a corollary to the foregoing, it is an important object of the present invention to thereby improve the operating efficiency of the engine under such conditions and maintain the level of polluting emissions of the engine at the lowest practical minimum.

Yet another important object of my invention is the provision of fuel enrichment means, as aforesaid, of such a design that virtually no adjustment is necessary or possible, thereby encouraging stable, reliable operation over prolonged periods of use while discouraging tinkering by the user or service personnel.

A further important object of this invention is to provide a way of heating the fuel as it enters the bore of the carburetor while avoiding materially raising the temperature of incoming air, thereby increasing the ability of the fuel to vaporize while avoiding any diminishment in the combustion efficiency of the cool air entering the engine.

A still further important object of this invention is to provide improved discharge jet construction such as to obtain more complete vaporization and finer droplet size with or without the use of means to heat the fuel being injected into the carburetor bore.

An overall important object of the present invention is, of course, to achieve increased operating efficiency and lower levels of polluting emissions as a result of all of the foregoing novel features.

Figures 1, 8, 9, 13, 14, 15:
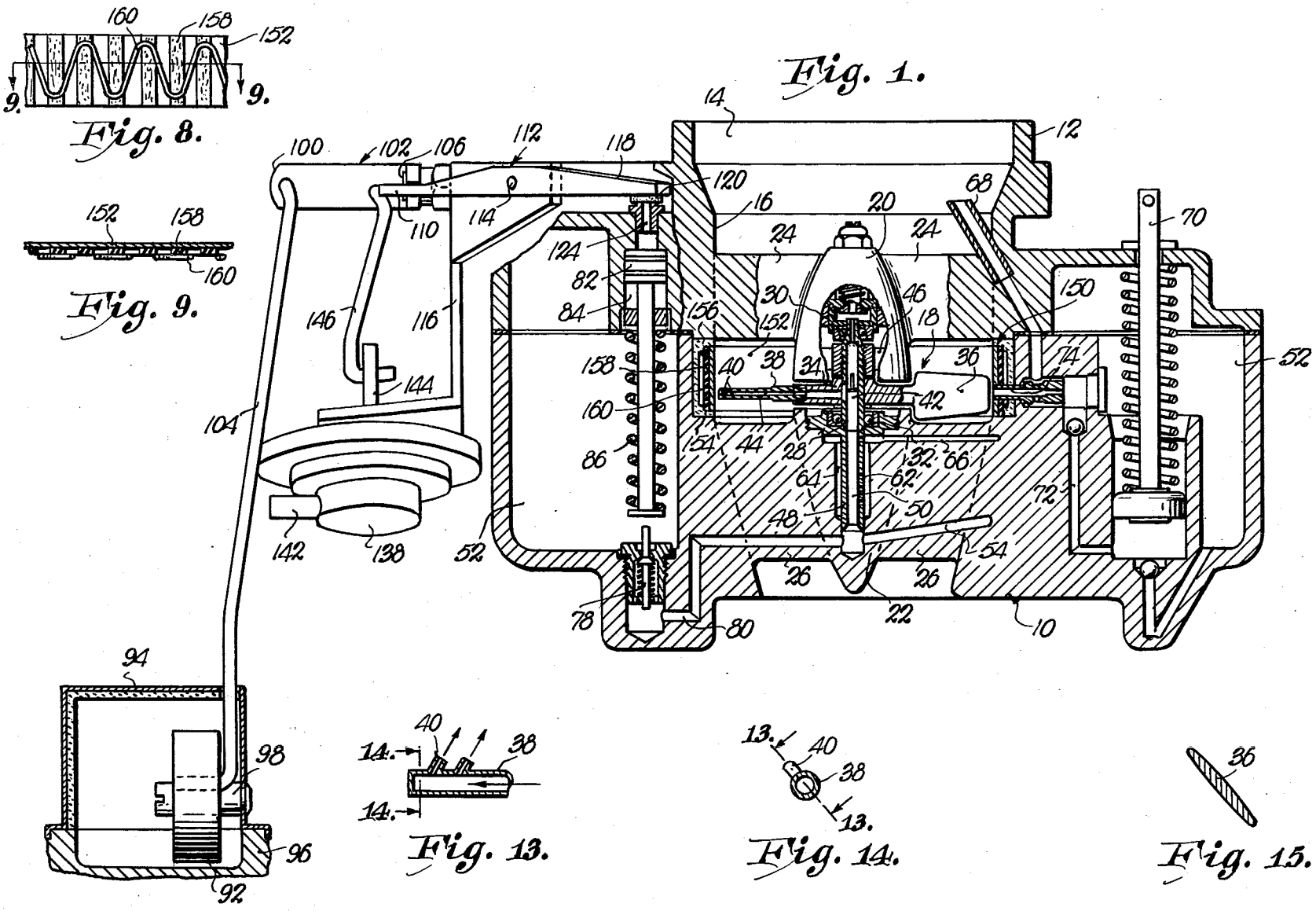
FIG. 1 is a vertical, cross-sectional view of a carburetor employing apparatus in accordance with the principles of the present invention.
FIG. 8 is an enlarged detail view, illustrating details of construction of the electrically energized vaporizing ring.
FIG. 9 is a cross-sectional view thereof taken along line 9—9 of FIG. 8.
Figure 5:
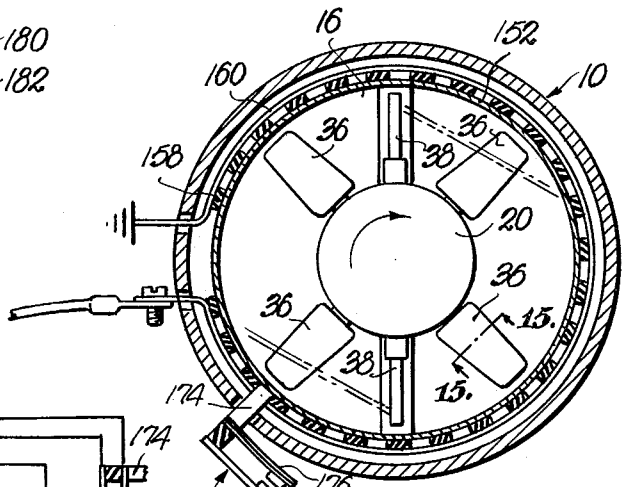
FIG. 5 is a horizontal, cross-sectional view through the carburetor, illustrating details of the electrically energized vaporizing ring.

FIGS. 13 and 14 are enlarged, fragmentary, cross-sectional views taken along lines 13—13 and 14—14, respectively, and illustrating details of construction of the fuel jets on the air motor of the carburetor; and FIG. 15 is an enlarged, cross-sectional view through one blade of the air motor and taken along line 15—15 of FIG. 5 to illustrate the pitch of such blade.

At the outset, it is to be emphasized that the principles of my present invention are especially well- suited for use in conjunction with injection carburetors of the type disclosed in my aforementioned patents, such carburetors being capable of achieving excellent fuel atomization and mixing. Hence, the principles of the present invention have been illustrated herein in conjunction with a carburetor of that type; however, it is to be recognized that such is done by way of example only and I do not wish to be limited to carburetors precisely as shown and described in said patents.

FUEL ENRICHMENT APPARATUS

Referring initially to FIGS. 1–4, the carburetor body 10 has a centrally disposed air horn 12 which defines a circular bore 14 through which air is drawn downwardly into the engine during operation. The bore 14 has a venturi restriction 16 intermediate its opposite ends, and an air motor or rotor, denoted generally by the numeral 18, is supported centrally within the venturi 16 by upper and lower bosses 20 and 22, respectively, in conjunction with upper and lower supporting fins 24 and 26, respectively, which radiate inwardly from the periphery of the bore 14.

The air motor 18 includes an upright, tubular spindle 28 which is supported for rotation about its longitudinal axis by upper and lower bearings 30 and 32, respectively. A hub 34 is integral with the spindle 28 for rotation therewith and has a series of radially outwardly projecting blades 36, having a pitch, such as illustrated in FIG. 15, in order to cause the motor 18 to spin as air is drawn downwardly through the bore 14 during operation.

The hub 34 is also provided with at least two tubular arms 38 which radiate outwardly in diametrically opposite directions from the hub 34 between a pair of the blades 36. Each arm 38 has one or more fuel discharge jets 40 adjacent its outermost end (to be described in more detail hereinafter), and the jets 40 are communicated with the central passage 42 of the spindle 28 by a passage 44 in the arm 38. If desired, an air turbine 46 may be provided on the spindle 28 directly above the air motor 18 constructed and operating in accordance with the teachings of my aforesaid U.S. Pat. No. 3,654,909.

An upright, tubular member 48 in the boss 22 below and in axial registration with spindle 42 has an upright passage 50 communicating with the passages 42 and 44. Passage 50, in turn, is communicated with the fuel compartment 52 by a bore 54 for the purpose of receiving the primary supply of the fuel to be discharged by the jets 40 into the bore 14 during operation. A throttle valve (not shown) has a shaft 56 (FIG. 4) which is connected through a crank 58 and a rod 60 to the throttle pedal (not shown) for manual control of the engine speed. The passage 50 is also communicated with the atmosphere by virture of orifices 62 and passages 64 and 66, which ultimately communicate with the impact tube 68 jutting upwardly into the bore 18 near the upper extent of the venturi 16.

The carburetor is also provided with an accelerating pump 70 which is mechanically linked by means not shown to the throttle valve shaft 56 for the purpose of permitting the operator to introduce additional fuel into the bore 14 during acceleration or at start-up when extra fuel is needed to assure ignition. The valved passageway 72 directs fuel from the accelerating pump 70 to an ejection nozzle 74 directed radially inwardly into the bore 14.

Under normal operating conditions, and after the engine has warmed up, the carburetor (as heretofore described) is operable to burn a relatively lean mixture of fuel and air without difficulty. It has been found desirable, however, to provide means for temporarily enriching the mixture during times of sudden acceleration, and heretofore this has been accomplished by providing a fuel enrichment valve which is responsive to the suction head created by the engine during operation. Thus, the present carburetor is provided with a fuel enrichment valve 76 (FIG. 1) in the floor of the fuel compartment 52 having a spring-loaded valve stem 78 which, when depressed, opens the valve 76 and permits fuel to flow through conduit 80 into the upright passage 50 and thence to the jets 40. An overhead piston 82, working within a chamber 84, is biased downwardly toward engagement with the valve stem 78 by a compression spring 86 within the fuel compartment 52. However, a bore 88 (FIG. 3) leading from the top of chamber 84 communicates the latter with the suction head of the engine manifold 90 such that the piston 82 is normally maintained by the suction head off the valve stem 78. During acceleration, when the suction head decreases, the piston 82 is urged downwardly by the spring 86 to depress the valve stem 78 and thereby open enrichment valve 76.

In accordance with the present invention, a way has been discovered to utilize the piston 82 and enrichment valve 76 to enrich the air fuel mixture during start up and initial running at low temperatures, all without interfering with the ability of such devices to carry out their normal fuel enrichment roles during normal running after initial warm-up. To this end, then, a thermostatic coil 92 is mounted within an insulated housing 94 secured to the exhaust manifold 96. A screw 98 supporting the coil 92 is swaged into the housing 94 to permit adjustment of the rotative position of the coil 92.

The free end of coil 92 is connected to the rearmost end 100 of a crooked operating lever 102 by a generally upright rod 104, the lever 102, in turn, being swingably secured to the carburetor body 10 adjacent the upper end of the bore 14 by a shaft 106 extending across the entire bore 14. The shaft 106 is rigidly secured to the lever 102 for swinging movement with the latter.

The front end 108 of the lever 102 overlies one end 110 of a second lever 112 which is secured intermediate its ends by a pivot 114 to a mounting bracket 116 fastened to the carburetor body 10. The opposite end 118 of the lever 112 carries a valve 120 that is normally biased by a spring 122 into sealing relationship with a bleed port 124 at the head of the piston chamber 84.

Consequently, when low temperature conditions prevail, the thermostatic coil 92 will exert an upward push on the rod 104 sufficient to rotate the lever 102 clockwise (viewing FIG. 3) about the axis of shaft 106 such as to depress the lever 112 and thereby open bleed port 124. As a result, the piston 82 cannot be maintained at the head of the chamber 84 by the suction head of the engine manifold, causing the piston 82 to depress the valve stem 78 and thereby introduce extra fuel into the bore 14 when the engine is cranked.

In addition to opening the fuel enrichment valve 78 under low ambient temperatures, the thermostatic coil 92 also is effective to set the throttle valve shaft 56 at a speed which is fast enough to insure that the engine will continue to idle once ignition has occurred. In this respect, the shaft 106 which is rotated by the thermostatic coil 92 is secured at the far side of the carburetor body 10 to a crank 126, the crank 126, in turn, being operably coupled with the fast idle cam 128 by a connecting rod 130. The cam 128 has a stepped surface 132 against which the adjusting screw 134 of the throttle crank 58 bears. Hence, when the thermostatic coil 92 rocks the crank 126 upwardly to its dotted line position illustrated in FIG. 4, such movement swings the cam 128 counterclockwise viewing FIG. 4 to rock the throttle valve shaft 56 clockwise to a partially open position.

A vacuum operated diaphram 136 is contained within a housing 138 on the mounting bracket 116, and the suction head of the engine is communicated to a chamber 140 beneath the diaphram 136 by a port 142 and other associated conduit means not illustrated. A slotted link 144 rising from the diaphram 136 receives an operating rod 146 which is, in turn, pivotally connected to the lever 102 between the shaft 106 and rear end 100.

Figure 3:
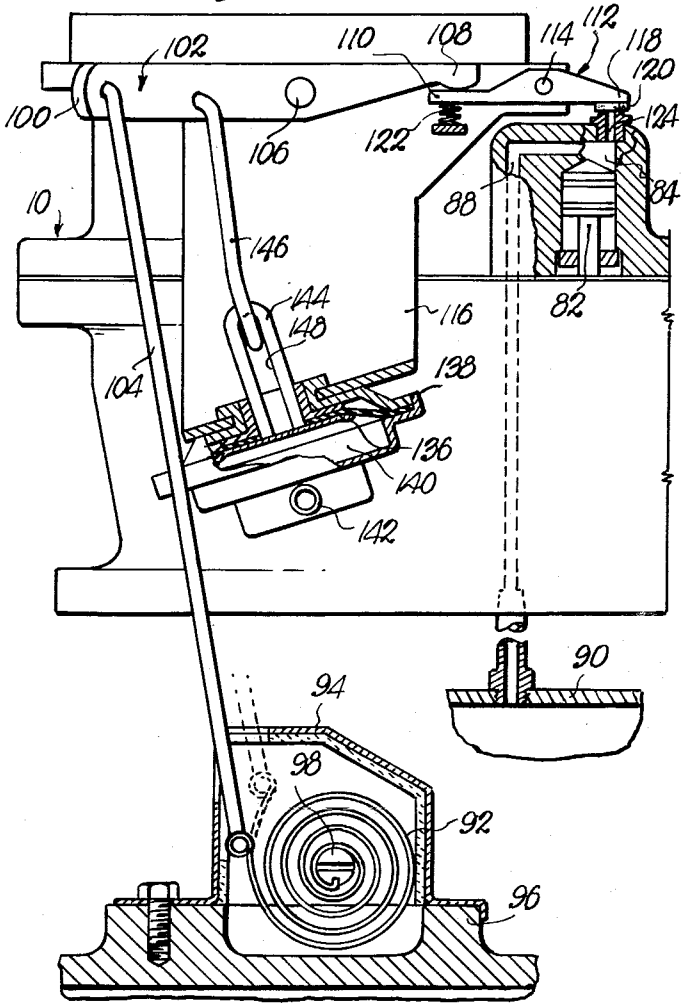
FIG. 3 is a side elevational view thereof, parts being broken away and shown in cross-section for clarity.
Figure 4:
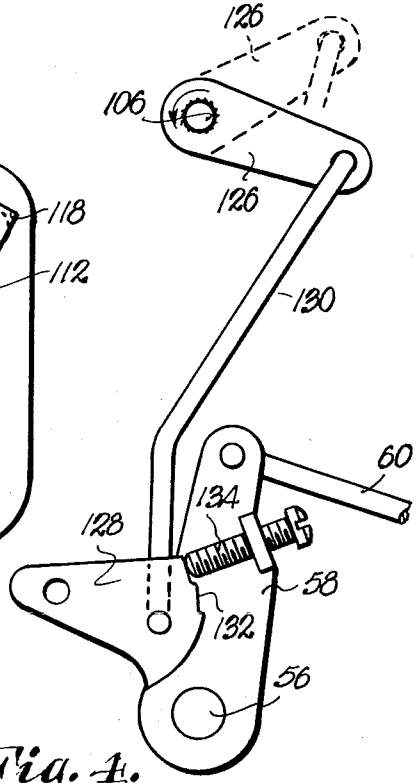
FIG. 4 is an isolated, elevational view of a portion of the apparatus of the present invention, illustrating its relationship to the throttle valve mechanism.
Figure 2:
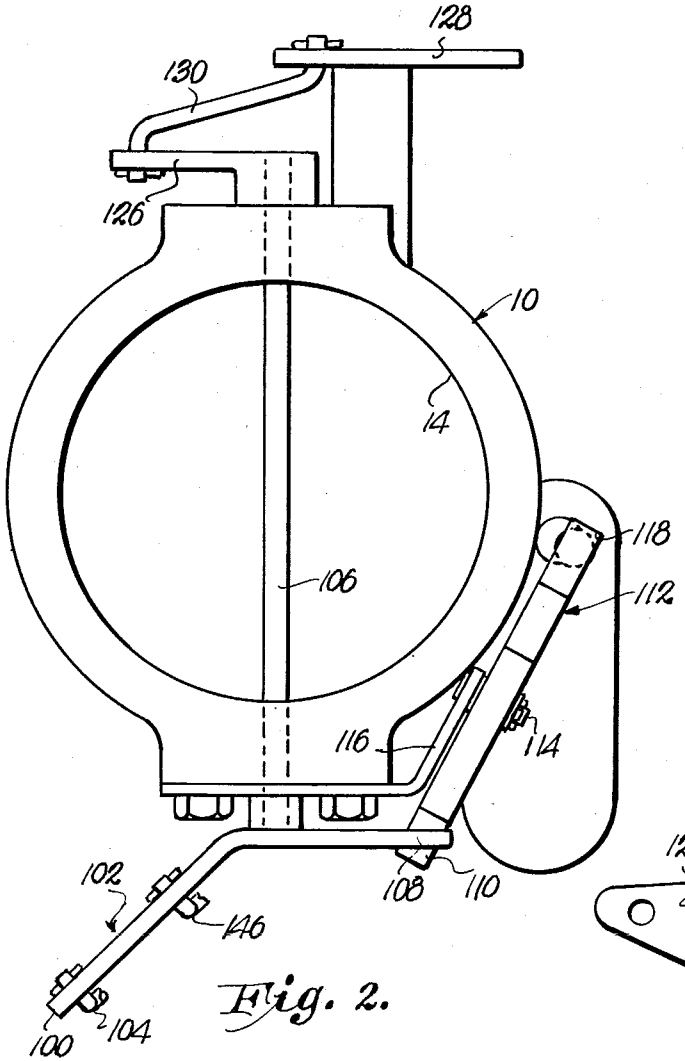
FIG. 2 is a top view thereof.

The rod 146 is slidably attached to the link 144 through its slot 148, and whenever the suction head from the engine is sufficiently high during warm-up and the upward force exerted by the thermostatic coil 92 is sufficiently weak, the suction head will pull the diaphram 136 downwardly within the chamber 140 such as to swing the lever 102 counterclockwise viewing FIG. 3. This enables the lever 112 to return the valve 120 against bleed port 124 to close the latter, hence permitting the suction head to raise the piston 82 and close the enrichment valve 76. This returns the air-fuel mixture delivered to the engine to its normal lean ratio for hot engine operation.

VAPORIZING RING

An electrically energized vaporizing ring, denoted broadly by the numeral 150, is illustrated in FIG. 1 about the periphery of the bore 14 in vertical alignment with the air motor 18. This aspect of my invention is particularly beneficial as a further assist during starting and running at low ambient temperatures, but it will be appreciated from the description which follows that its principles may also be utilized advantageously during normal operation at higher temperatures.

With particular attention to FIGS. 5–9, it may be seen that the vaporizing ring 150 includes an annular heat conductive element in the nature of a band 152 of copper or the like. The band 152 is flush with the walls of the bore 14 and is supported within an annular recess 154 by a surround 156 of asbestos or other suitable insulating material. Vertically disposed short strips 158 of asbestos are circumferentially spaced about the outside of the band 152 and maintain the latter electrically insulated from a serpentine electrical conductor 160 which circumscribes the strips 158. The exposed areas between adjacent strips 158 permit the transfer of heat from the conductor 160 to the band 152.

Figure 7:
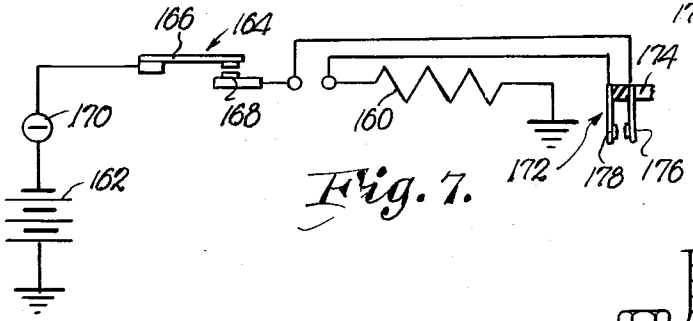
FIG. 7 is a schematic wiring diagram for the electrical vaporizing ring of FIGS. 5 and 6.

Electrical energy to heat the conductor 160 may be supplied from a source such as the electrical storage battery 162 illustrated in the schematic wiring diagram of FIG. 7. A normally closed switch 164 may utilize a bi-metal arm 166 which is set to open at a predetermined ambient temperature when the arm 166 swings away from its contact 168. Further, any suitable manually operable switch, such as the ignition switch 170 on the vehicle, may be inserted within the circuit to energize the conductor 160 only when the switch 170 is closed, regardless of the condition of the thermostatic switch 164. Still further, another temperature responsive switch 172 may be inserted into the circuit as a safety device to prevent the band 152 from overheating. A heat conductor 174 projecting laterally from the band 152 is disposed in heat transfer relationship with a bimetal arm 176 of the switch 172 for the purpose of causing the arm 176 to swing away from its contact 178 to open the circuit when a certain predetermined high temperature is sensed in the band 152.

Accordingly, if the ambient temperature is low enough (such as below 60° for example), the thermostatic switch 164 is in its closed position, as, of course, is the thermostatic switch 172, inasmuch as the band 152 is cool prior to start-up. Turning the ignition key such as to close the ignition switch 170 therefore causes the conductor 160 to be energized, and in a very short period of time, the conductor 160 will raise the temperature of the band 152 to approximately 700° Fahrenheit.

When the operator then pumps the accelerating pump 70 several times, fuel is ejected from the nozzle 74 into the bore 14, and because the nozzle 74 projects through the band 152 in heat transfer relationship therewith, the fuel stream issuing from nozzle 74 is heated. This heat transfer encourages the fuel to vaporize as it encounters the downdraft of air within the bore 14 in spite of the low temperature conditions existing within the latter. Moreover, such increase of vaporization on the part of the fuel is achieved without heating the air that is drawn into the bore by the cranking engine. Since the band 152 is flush with the walls of the bore 14 and the nozzle 74 is embedded within the asbesto surround 156 and only in heat transfer relationship with the copper band 152, the incoming air has little opportunity to pick up heat from the band 152 or from the walls of the bore 14 which might otherwise be heated were it not for the asbestos surround 156.

Interestingly, it has been found that when the circuit is first energized under low temperature conditions and after a prolonged idle period, the asbestos surround 156 which has been soaked with fuel from a previous operation begins to emit vapors even before the accelerating pump 70 is depressed to inject additional fuel into the bore 14. Hence, the engine is ready to start sooner and more instantaneously than might be expected.

Once the engine has ignited and is running smoothly, the under-hood temperature rises until the thermostatic switch 164 opens the circuit to de-energize the heating conductor 160. In some situations, it may be desirable to maintain the vaporizing ring in operation longer than just during initial start-up and run, in which event it would be desirable to provide a relay in the system to break the circuit with the storage battery 162 and provide the energy from the generator. With such prolonged use, the safety switch 172 may become a more important factor. Moreover, if more rapid than usual heat-up of the band 152 is desired, the electrical resistance of the conductor 160 may be varied so as to provide the desired rate of heat-up. Here, again, the safety switch 172 becomes an important factor because overheating the ring 152 to the flash point of the fuel being injected into the bore would cause the fuel to become ignited.

Figure 10:
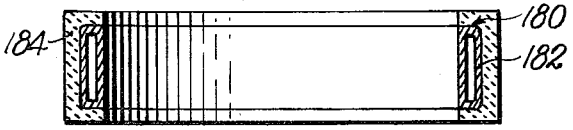
FIG. 10 is an enlarged, vertical, cross-sectional view through a second version of the vaporizing ring which utilizes hot engine gasses as its heat transfer medium.

FIG. 10 shows an alternative version of vaporizing ring denoted by the numeral 180 and heated by a fluid heat transfer medium such as hot engine gasses. The vaporizing ring 180 comprises an annular tube 182 that is designed to circumscribe the air motor 18 in the same manner as the ring 150. As in the first version, an asbestos surround 184 firmly retains the tube 182 within the recess 154 of the carburetor body 10 and provides heat insulation for the tube 182. The tube 182 may be constructed from many suitable materials, such as, for example, copper.

Figure 11:
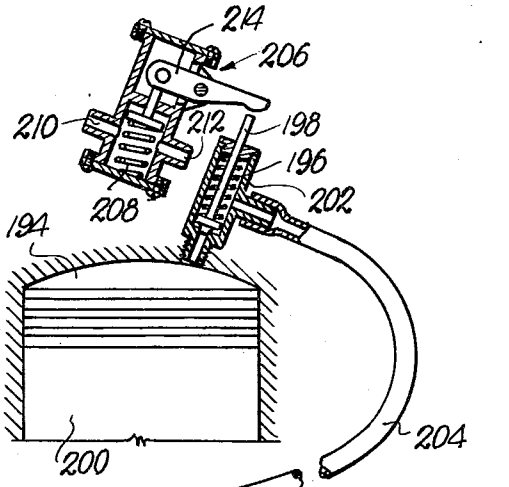
FIG. 11 is a schematic view of the hot gas version of the vaporizing ring on a reduced scale, illustrating its intended manner of use.
Figure 11:
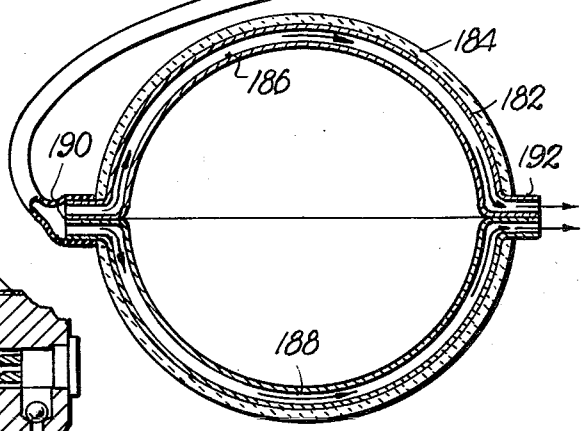

As illustrated in FIG. 11, the tube 182 has two 180° sections, 186 and 188, which cooperate to define the entire 360° ring. For purposes of efficiency and ease of design, the fluid flow entering the tube 182 at its inlet 190 is divided for flow in separate paths through the sections 186 and 188 until ultimately recombined at the outlet 192.

The hot fluid used to raise the temperature of the tube 182 may comprise engine gasses such as created in the engine cylinder 194 during initial cranking. If the ambient temperature is below a selected level, a thermostatic spring 196 may allow the valve 198 to unseat in response to pressure from the engine piston 200, thereby causing hot gasses to flow out of the valve housing 202, through a line 204, and into the inlet 190 of tube 182. The outlet 192 may be communicated with the exhaust manifold.

If desired, a thermostatically actuated override device 206 may be utilized to keep the valve 198 closed after a predetermined period of time, regardless of ambient temperature conditions. To this end, the override device 206 employs a thermostatic spring 208 which is disposed in fluid communication with a source of engine coolant through the inlet 210 and the outlet 212. When a predetermined temperature is achieved by the engine coolant flowing in contact with the spring 208, the latter exerts a clockwise force on the lever 214 to depress the valve 198 and keep it seated.

In operation the gas energized vaporizing ring 180 functions in much the same way as the electrical version 150. As before, the ejecting nozzle 74 from the accelerating pump 70 passes through the asbestos surround 184 and the tube 182 such as to become heated. Consequently, the fuel issuing from nozzle 74 likewise becomes heated to urge the fuel to vaporize.

Figure 12:
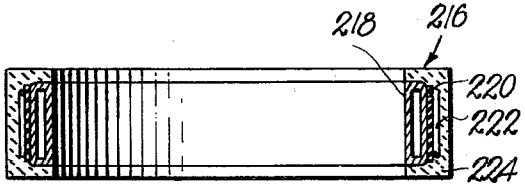
FIG. 12 is an enlarged, cross-sectional view of a third form of vaporizing ring which combines both electrical and hot gas principles of operation.

FIG. 12 illustrates a third version of vaporizing ring denoted by the numeral 216. That arrangement combines the principles of the electrically energized ring 150 and the gas-heated ring 180. Its construction is much the same as the electrical version 150, except for the fact that the band 152 of the latter is replaced with a tube 218. Asbestos strips 220, the electrical conductor 222, and the asbestos surround 224, are retained.

One advantage of this embodiment lies in the fact that it may be energized electrically prior to engine cranking such as to heat the discharging nozzle 74 before trying to start the engine. Then, once the engine is running smoothly, the electric circuit can be opened and the hot gasses flowing through tube 218 relied upon to heat the nozzle 74 and provide a warm surface against which the fuel may impinge within the carburetor bore 14.

Noteworthy with regard to all three of the foregoing versions of vaporizing ring is the fact that when in use, the ring helps to produce a completely vaporized mixture, even during the crucial acceleration phase when manifold vacuum is low and the fuel, although in vapor form, tends to precipitate onto the manifold walls. The additional vaporizing ability provided by the ring at this time encourages smooth, strong acceleration without any hesitation. It is to be noted further that by using the vaporizing ring to increase the ability of the fuel to vaporize, the volume of fuel dejected by the accelerating pump 70 may be significantly reduced. Less fuel is thereby used and that which is used, burns completely as a result of improved vaporization and mixture with air.

AIR MOTOR FUEL JETS

The jets 40 on the tips of air motor arms 38 are disposed in relatively close proximity to the walls of the bore 14 by virtue of the extended length of the arms 38. As illustrated in FIGS. 5 and 13, each jet 40 is directed inwardly toward the axis of rotation of the motor 18 at an angle of approximately 30° from a tangent to the arc of travel of the jets 40 during rotation of the motor 18. Moreover, the jets 40 are directed forwardly with respect to the direction of rotation of the motor 18 such that the force of the air within the bore 14 is applied against the face of the jets 40 as they rotate.

Figure 6:
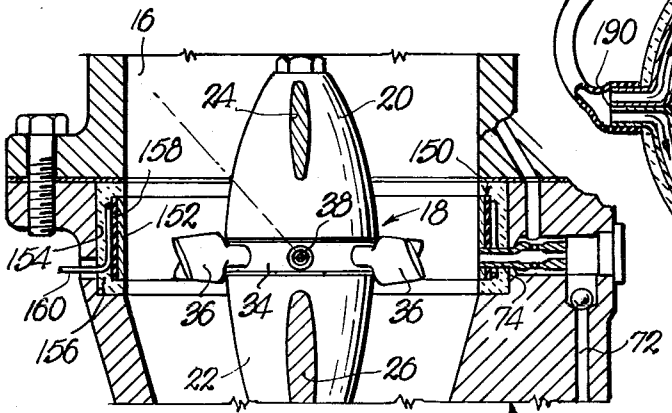
FIG. 6 is a fragmentary, vertical, cross-sectional view through the carburetor, illustrating the same details.

In addition, as illustrated in FIGS. 6 and 14, each jet 40 is directed upwardly out of the plane of rotation of the arms 38 at an angle of approximately 40°, thereby discharging the fuel in counterflow relationship to the downwardly rushing air through the bore 14.

The long nozzle arms 38 give approximately twice the pressure on the fuel as compared to the pressure available in the device of my prior patents. Furthermore, the resultant angle of fuel stream flow from the jets 40 assures that the fuel will have maximum time in the bore 14 for atomization, and due to the increased relative velocity of the fuel and air because of the geometry of the jets 40, the average fuel droplet size is drastically reduced. In addition, this new design assures that any fuel not atomized by impingement against the incoming air will be directed onto the vaporizing ring 150, 180 or 216, for completion of the vaporization. As a result of these factors, the diameter of the jets 40 may be reduced significantly which still further increases the ease of vaporizing the fuel.

It should, therefore, be apparent from the foregoing that the various features of the present invention serve both collectively and individually to not only facilitate starting and initial running under low temperature conditions, but also to substantially increase the operating efficiency of the engine and reduce the level of pollutants. While each is capable of performing admirably without the assistance of the other; nonetheless, when taken as a whole and used in combination with one another, they produce a total effect unequaled by conventional carburetor apparatus.

Having thus described the invention, what is claimed as new and desired to be secured by Letters Patent is:

1. In a carburetor for use with an internal combustion engine, said carburetor having an air horn defining a central bore, an air rotor rotatable within said bore in response to ambient air drawn into and through the bore during engine operation, at least one liquid fuel discharge jet on the rotor and rotatable therewith, and means for supplying the jet with liquid fuel during said rotation of the rotor, the improvement comprising:

said jet being positioned to direct a stream of fuel forwardly with respect to the direction of rotation of the rotor and therefore against the force of air within the bore, said jet being disposed in close proximity to the periphery of the bore, said jet also being directed at least partially radially inwardly toward the axis of rotation of the rotor, said jet also being directed at least partially in counterflow relationship to the normal direction of travel of air through the horn.

2. In a carburetor for use with an internal combustion engine as claimed in claim 1, wherein said jet is inclined into opposition to said direction of air travel at an angle of approximately 40° from the plane of rotation of the jet.

3. In a carburetor for use with an internal combustion engine as claimed in claim 1, wherein said jet is directed inwardly at an angle of approximately 30° from a tangent to the arc of travel of the jet.

4. In a carburetor for use with an internal combustion engine, said carburetor having an air horn defining a central bore, and air rotor rotatable within said bore in response to ambient air drawn into and through the bore during engine operation, at least one liquid fuel discharge jet on the rotor and rotatable therewith, and means for supplying the jet with liquid fuel during said rotation of the rotor, the improvement comprising:

said jet being positioned to direct a stream of fuel in at least partial counterflow relationship to the normal path of travel of air through the horn, said jet also being positioned to direct the stream forwardly with respect to the direction of rotation of the rotor and, therefore, against the force of air within the bore, said jet being disposed in close proximity to the periphery of the bore, said jet also being directed at least partially radially inwardly toward the axis of rotation of the rotor.

5. In a carburetor for use with an internal combustion engine as claimed in claim 4, wherein said jet is inclined into opposition to said direction of air travel at an angle of approximately 40° from the plane of rotation of the jet.

6. In a carburetor for use with an internal combustion engine as claimed in claim 4, wherein said jet is directed inwardly at an angle of approximately 30° from a tangent to the arc of travel of the jet.

* * * * *